United States Patent [19]

Anbe

[11] Patent Number: 4,615,259

[45] Date of Patent: Oct. 7, 1986

[54] RECIPROCATING GAS COMPRESSOR

[75] Inventor: Yoshinori Anbe, Amagasaki, Japan

[73] Assignee: Showa Precision Machinery Co., Ltd., Amagasaki, Japan

[21] Appl. No.: 709,759

[22] Filed: Mar. 8, 1985

[30] Foreign Application Priority Data

Apr. 21, 1984 [JP] Japan ..... 59-80808

[51] Int. Cl.[4] ..... F01B 31/00; F04B 5/00; F16J 15/50

[52] U.S. Cl. ..... 92/86; 417/266; 417/267; 417/536; 74/18.2

[58] Field of Search ..... 417/534–536, 417/265, 267; 74/18.2; 92/86

[56] References Cited

U.S. PATENT DOCUMENTS

| | | | |
|---|---|---|---|
| 918,194 | 4/1909 | Pocock | 417/265 |
| 1,696,436 | 12/1928 | Gray | 417/534 |
| 2,702,008 | 2/1955 | Stockard | 417/267 |
| 3,473,726 | 10/1969 | Backmann | 74/18.2 |
| 3,744,936 | 7/1973 | Sadler | 417/536 |
| 4,373,876 | 2/1983 | Nemoto | 417/534 |
| 4,492,127 | 1/1985 | Kuhn | 417/534 |
| 4,495,855 | 1/1985 | Murakini | 92/168 |

FOREIGN PATENT DOCUMENTS

| | | | |
|---|---|---|---|
| 1034867 | 8/1953 | France | 417/534 |
| 2273961 | 6/1974 | France | 417/534 |
| 300659 | 4/1971 | U.S.S.R. | 417/267 |

*Primary Examiner*—William L. Freeh
*Attorney, Agent, or Firm*—Millen & White

[57] ABSTRACT

A Scotch yoke mechanism for actuating opposed-piston gas compressor is disclosed. The mechanism comprises a crank pin eccentrically extending from an end of a main drive shaft, a slider rotatably surrounding the crank pin, and a yoke defining a pair of opposed parallel sliding surfaces for confining the motion of the slider only to the sliding motion along the surfaces, said yoke further defining a pair of outwardly extending connecting rods for connecting oppositely disposed pistons on either side of the york, whereby the orbital motion about the axis of the main drive shaft causes the slider to reciprocate the yoke and thus oppositely disposed pistons.

1 Claim, 2 Drawing Figures

RECIPROCATING GAS COMPRESSOR

BACKGROUND OF THE INVENTION

The present invention relates to a small-sized reciprocating gas compressor and particularly to an oilless gas compressor and more particularly to an oilless gas compressor for use at cryogenic temperatures.

Generally, reciprocating compressors require lubricating oil to be used between the piston and the cylinder. In cases where such compressor is used as a gas compressor, e.g., as a nitrogen gas compressor in a nitrogen liquefying system, it is required that no lubricating oil be used between the piston and the cylinder, since migration of lubricating oil to the nitrogen would result in the icing of oil, which is undesirable from the standpoint of production of cryogenic temperature. Such a gas compressor is called an oilless gas compressor.

Various types of oilless gas compressors are known. These include the use of a fluid lubricant other than lubricating oil in the cylinder or the use of a special material which is lubricative for the inner slide area of the cylinder without using liquid lubricants. It is also known to use a diaphragm or bellows for indirect intake and exhaust of gas. Another approach includes the use of a rod packing being in contact with the piston rod, which is reciprocating through the guide piston or the use of some other form of oil creep-up preventing device, thereby preventing oil from moving along the piston rod to enter the cylinder.

However, these known types of oilless gas compressors can hardly be practical as cryogenic temperature producing gas compressors, particularly as small-sized ones.

BRIEF SUMMARY OF THE INVENTION

According to the present invention, there is provided a reciprocating gas compressor comprising a pair of oppositely disposed compression heads each defining at least one cylindrical compression chamber, a plurality of oppositely disposed pistons associated with said pair of compression heads; and means disposed between said pair of compression heads for reciprocating said plurality of piston toward and away from said pair of compression heads on each side thereof. According to the present invention, said means for reciprocating said plurality of pistons comprises a crank pin extending from an end of a main drive shaft, the axis of said crank pin being eccentric relative to said main drive shaft; a slider rotatably surrounding said crank pin; and a yoke defining a pair of opposed parallel sliding surfaces for confining the motion of said slider only to the sliding motion along said pair of sliding surfaces, said yoke further defining a pair of outwardly extending rods for connecting said plurality of pistons to the yoke on each side thereof, whereby the orbital motion of said crank pin about the axis of said main drive shaft causes said slider to reciprocate said yoke and thus said plurality of pistons connected thereto toward and away from said pair of compression heads.

BRIEF DESCRIPTION OF THE DRAWINGS

The arrangement of the invention will now be described with reference to the accompanying drawings showing an embodiment of the invention.

DESCRIPTION OF THE PREFERRED EMBODIMENT

Figure 1:
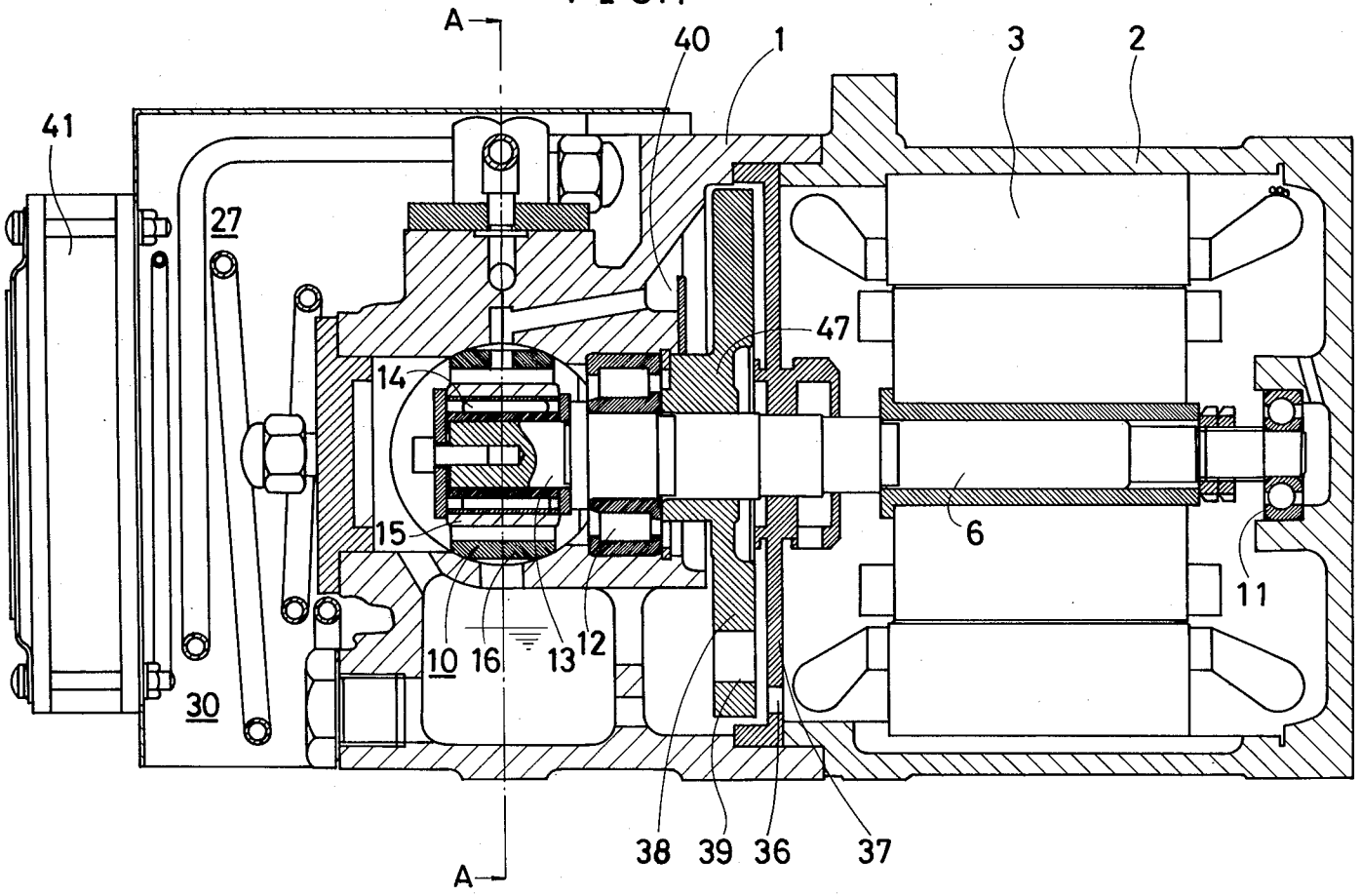
FIG. 1 is a complete sectional side view of an embodiment of the invention.

This embodiment is a three-stage reciprocating oilless gas compressor capable of compressing, for example, nitrogen gas to a pressure of 140 kg/cm$^2$. The compressor may be a portable small-sized compressor of the opposed piston type.

The opposed piston compressor shown in the drawings comprises a compressor housing 1 and a motor case 2 connected to the compressor housing. A first compression head 4 coaxially defining first and third cylindrical compression chambers 42, 43, and a second compression head 5 defining a second cylindrical compression chamber 44 are arranged within the housing 1 in an opposed relation. Arranged between the first and second compression heads 4, 5 is a Scotch yoke mechanism generally designated by the reference numeral 10 which reciprocates a first stage piston 7 and a third stage piston 8 coaxially and integrally extending from the first stage piston within their respective compression chambers 42, 43 on one side of the mechanism, and a second stage piston 9 within the chamber 44 on the other side thereof.

A main shaft 6 extends from a main motor 3 to the Scotch yoke mechanism 10 and is driven by the motor 3. The main shaft 6 is supported in a bearing 11 installed in the lateral plate of the motor case 2 at one end and a roller bearing 12 installed in the compressor housing 1 at the other end. Scotch yoke mechanism 10 is connected to the other end of the main shaft 6.

The Scotch yoke mechanism 10 is constructed as follows.

A crank pin 13 is integrally formed on said other end of the main shaft 6 in an eccentric relation to the axis of the main shaft 6. A slider 15 is fitted on the crank pin 13 through a needle bearing 14. Said slider 15 is confined by a pair of parallel sliding surfaces 45, 46 defined by a yoke 16 and slidable along surfaces 45, 46. The slider 15 and yoke 16, in FIG. 2, define spaces on the upper and lower sides, but at right and left they contact each other. Eccentric motion of the crank pin 13 causes reciprocating motion of rods 17 and 18 projecting from the yoke 16. Threadedly fitted on these rods 17 and 18 are the aforesaid first and second stage pistons 7 and 9, respectively.

An operation chamber or central space 19 in which the yoke 16 is housed is isolated by diaphragms 22 and 23 from first and second lateral spaces which define operation chambers 20 and 21 in which the first and second stage pistons 7 and 9 are reciprocated. The lubricating oil in the operation chamber 19 housing the yoke 16 is completely shut off from the operation chambers 20 and 21 in which the first and second stage pistons 7 and 9 are reciprocated. In addition, the yoke 16, as shown in FIG. 1, is arcuate at its upper and lower surfaces so that the rods 17 and 18, or the first and second stage pistons 7 and 9, are allowed to reciprocate smoothly but cannot move at right angles to such reciprocating motion.

Figure 2:
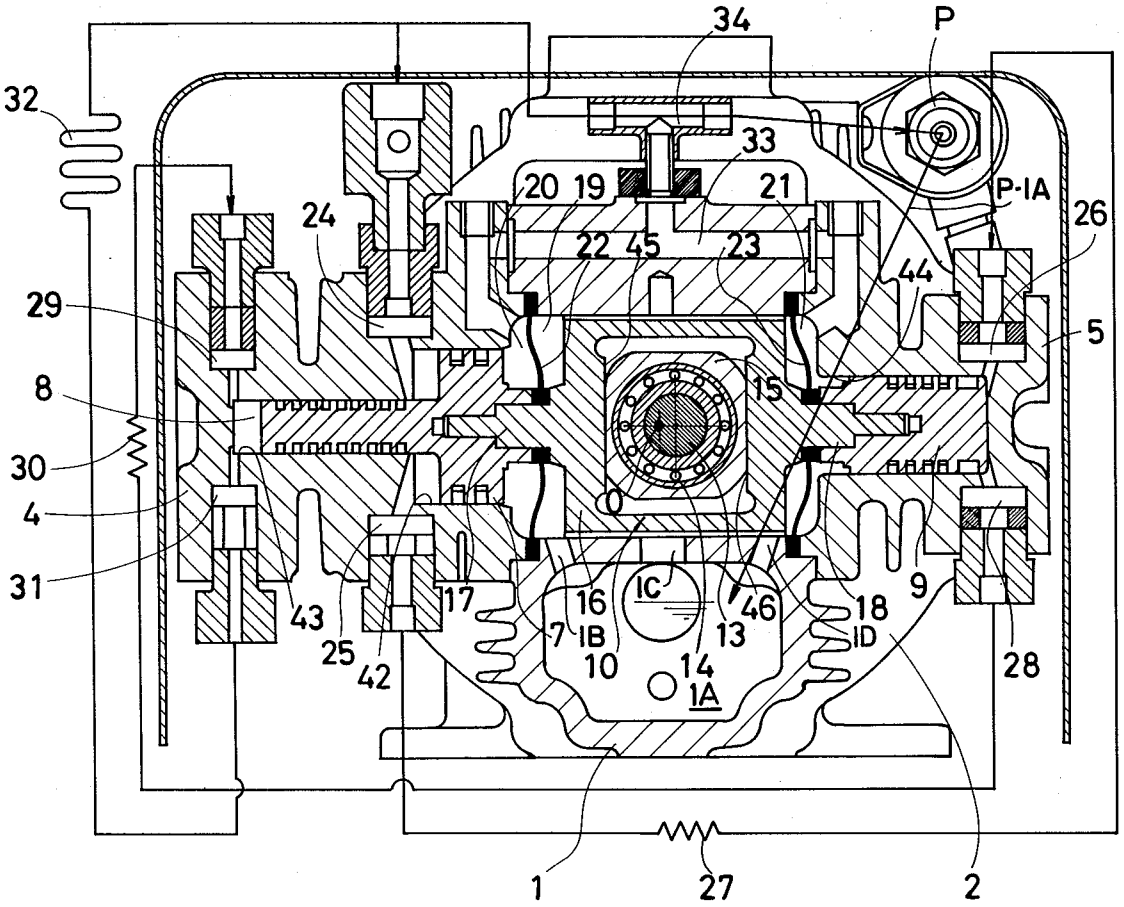
FIG. 2 is a sectional view taken along the line A—A of FIG. 1.

As shown in FIG. 2, an intake valve 24 and an exhaust valve 25 are provided adjacent the bottom end of the first stage compression chamber 42. Similarly the second stage compression chamber 44 is provided with an intake valve 26 and an exhaust valve 28 and the third stage compression chamber 43 is provided with an intake valve 29 and an exhaust valve 31. Valve 25 is connected by a conduit to valve 26 through a cooler 27. Similarly, valve 28 is connected by a conduit to valve 29 through a cooler 30. Valve 31 is connected to a Joule-Thomson valve 32 so that the nitrogen gas from said Joule-Thomson valve 32 returns to the intake valve 24 for the first stage compression chamber 42.

Further, in this embodiment, since the diaphragms 22 and 23 are provided, the fluid pressures in the operation chambers 19, 20 and 21 separated from each other by the diaphragms 22 and 23 are made substantially equal to prevent deformation due to difference in pressures across the diaphragms. That is, the operation chamber 20 for the first stage piston 7 communicates with the operation chamber 21 for the second stage piston 9 through a communication passageway 33 for pressure adjustment. The communication passageway 33 is bifurcated as at 34, one branch communicating with the intake valve 24 and the other being open adjacent the Scotch yoke mechanism 10 via a purifier P, thereby equalizing internal pressures at the various areas in the compressor housing. The purifier P is connected to chamber 1A via line P-1A. Chamber 1A is open via ports 18, 1C and 1D to yoke housing 19.

The motor case 2 communicates with the compressor housing 1 through a communication hole 36 formed in a wall 37, so that the lubricating oil moves between the two, but the provision of the wall 37 ensures that little of the nitrogen gas introduced into the compressor housing 1 through the purifier P flows into the motor case 2. The numeral 38 denotes a flywheel fixed on the maih shaft 6. The flywheel 38 has a thick boss 47 and a balancing hole 39, thus balancing the motion of the Scotch yoke mechanism 10 while performing the flywheel function. Further, since the flywheel 38 is rotated while being partially immersed in the lubricating oil, it performs the function of a lubricating oil pump to bring some of the lubricating oil up into a receive portion 40 and also the function of a damper which works by the viscosity of the lubricating oil.

The numeral 41 denotes a case which houses a small-sized motor-equipped fan which cools the outer surfaces of the coolers 27 and 30 and compressor housing 1.

In this embodiment, nitrogen gas having a pressure of about two atmospheres is sealed in the compressor housing 1 in advance, and nitrogen gas to be compressed is fed through the communication passageway 33. Then, the main motor 3 is started to rotate the main shaft 6 about the center 0 as shown in FIG. 2. The rotation of the main shaft 6 causes the eccentric motion of the crank pin 13. As a result, the vertical movement of the slider 15 is effected in the space of the yoke 16, while the horizontal movement of the slider is converted into the reciprocating motion of the yoke 16. Thus, the first stage, third stage and second stage pistons 7, 8 and 9 are reciprocated in the heads 4 and 5 to progressively compress the nitrogen gas, starting with the first stage piston 7. The nitrogen gas exhaused from the third stage compression chamber 43 performs a predetermined work at the Joule-Thomson valve 32 to have its pressure reduced and then returns to the intake valve 24 of the first stage compression chamber 42.

The nitrogen gas sealed in the compressor housing 1 deflects the diaphragms 22 and 23 with the reciprocating motion of the first, second and third stage pistons 7, 9 and 8. However, since the operation chambers 20 and 21 communicate with each other through the communication passageway 33 and since another part of the enclosed nitrogen gas also flows into the operation chamber 19 through the purifier P which is impermeable to mists of lubricating oil, these operation chambers are kept at a substantially uniform nitrogen pressure.

Lubrication of the Scotch yoke mechanism 10 is effected by the scooping action of the flywheel 38 and through the receive portion 40.

The above embodiment offers a number of advantages over the prior art compressors including its compact size, reduction of the number of parts, ease in operation and maintenance and the like.

I claim:

1. A reciprocating gas compressor comprising a pair of oppositely disposed compression heads, the first of which compression heads defines a single compression chamber in a first lateral space for receiving a single piston having a complementary configuration and the second of said compression heads defining a pair of coaxially extending cylindrical compression chambers in a second lateral space, each chamber receiving a complementary piston and each chamber being of a different diameter;

means for reciprocating said pistons, said reciprocating means including a crank pin extending from the end of a main drive shaft, the axis of said crank shaft being eccentric relative to said main drive shaft;

a slider rotatably surrounding said crank shaft;

a yoke disposed in a central space defining a pair of opposed lateral sliding surfaces for confining the motion of said slider only to sliding motion along said pair of sliding surfaces, said yoke further defining a pair of outwardly extending rods for connecting said plurality of pistons to either side of the yoke, wherein the orbital motion of said crank pin about the axis of said main drive shaft causes said slider to reciprocate said yoke and thus said pistons connected thereto toward and away from said pair of compression heads;

a pair of diaphragms interposed between said pair of compression heads and said yoke on either side of said yoke for sealingly separating said lateral spaces of said pair of compression heads from the central space within which said yoke is reciprocated to prevent migration of lubricating oil from said central space into the lateral space containing said pair of compression heads, and means for equalizing fluid pressures across said pair of diaphragms when said yoke is reciprocated within said central space, said equalizing means including a passageway means in communication with the lateral spaces by connections thereto and in communication with a central space within which said yoke is reciprocated by a connection thereto, said equalizing means further including a purifier disposed in said passageway means at a location between the connection to the central space and connections to the lateral spaces, whereby oil mist is prevented from migrating from the central space to the lateral spaces by said purifier while pressure on both sides of each of the diaphragms is equalized.

* * * * *